United States Patent [19]

Santo

[11] Patent Number: 4,696,071

[45] Date of Patent: Sep. 29, 1987

[54] DECK FOR SUPPORTING A FLOATATION SLEEP SYSTEM BLADDER

[76] Inventor: Philip J. Santo, 12 Mountain Rd., Rochester, N.Y. 14625

[21] Appl. No.: 889,231

[22] Filed: Jul. 25, 1986

[51] Int. Cl.[4] ..... A47C 27/08; A47C 19/00

[52] U.S. Cl. ..... 5/451; 5/417; 5/400

[58] Field of Search ..... 5/465, 417, 420, 451, 5/452, 400

[56] References Cited

U.S. PATENT DOCUMENTS

| | | | |
|---|---|---|---|
| 1,356,593 | 10/1920 | Bettiker | 5/420 |
| 3,284,819 | 4/1966 | Nissen | 5/420 |
| 3,323,151 | 6/1967 | Lerman | 5/465 |
| 3,336,610 | 8/1967 | Geddings | 5/420 |
| 3,761,974 | 10/1973 | Kuss | 5/451 |
| 4,186,452 | 2/1980 | Underwood | 5/400 |
| 4,399,972 | 8/1983 | McCulloch | 108/51.3 |

FOREIGN PATENT DOCUMENTS

| | | | |
|---|---|---|---|
| 2009594 | 6/1979 | United Kingdom | 5/465 |
| 1586982 | 3/1981 | United Kingdom | 5/465 |

*Primary Examiner*—Alexander Grosz
*Attorney, Agent, or Firm*—Lawrence P. Kessler

[57] ABSTRACT

Deck construction for a floatation sleep system which gives the deck a high quality finished appearance and facilitates transportation and set up thereof. The deck includes a plurality of rigid members. Such members are separately encased as a unit, hingeable between the members. Several units may be secured together in a planar relationship to have an overall dimensional surface area substantially equal to the surface area of a particular size fluid-filled bladder. The encasing for the rigid members is of a decorative nature to enhance the appearance of the deck.

6 Claims, 3 Drawing Figures

DECK FOR SUPPORTING A FLOATATION SLEEP SYSTEM BLADDER

BACKGROUND OF THE INVENTION

This invention relates in general to floatation sleep systems, and more particularly to a deck for supporting the bladder of a floatation sleep system.

Floatation sleep systems have of recent had a wide acceptance as an alternative sleep system to conventional bedding due to the superior restful sleepinducing properties resulting from the uniform distribution of body pressure over the sleep surface. A typical floatation sleep system comprises a fluid-filled, flexible-walled bladder supported on a pedestal covered by a platform or deck. The pedestal and deck are constructed of rigid structural material so as to substantially uniformly distribute the weight of the bladder. Such structural material is, for example, wood or a wood composition such as flake or particle board.

A commercial limitation faced by the floatation sleep industry has been that the typical pedestal and deck construction, as generally supplied by the industry, has prevented trade to that segment of the market which desires to personally carry out the complete floatation sleep system from the retail outlet and set up the system on their own. This is because the size and weight of the pedestal and deck do not easily lend themselves to ordinarily available transportation or ready set up.

Since the bladder of the floatation sleep system is compact and light weight (before being filled with fluid), it has a strong appeal over conventional bedding to the above mentioned market segment. Therefore, strong efforts have been made to make transportation and set up of the pedestal and deck easier. For example, the pedestal and deck can be made in readily assemblable pieces such as shown in my co-pending U.S. patent application Ser. No. 712,629, filed Mar. 18, 1985. Alternatively, as shown in my U.S. Pat. No. 4,224,705, issued Sep. 30, 1980, the pedestal can be made in a form which permits it to be readily collapsed for transportation to the customer site and easily expanded for set up. While such arrangements facilitate transport to the customer's site, considerable labor is still required for complete set up of the pedestal and deck. Moreover, the deck, in and of itself, does not have a finished appearance which would give the floatation sleep system a high quality look. Accordingly it is generally required that the deck have additional framing such as to cover the bare marginal perimeter of the board structure making up the deck.

SUMMARY OF THE INVENTION

This invention is directed to a deck construction for a floatation sleep system which gives the deck a high quality finished appearance and facilitates transportation and set up thereof. The deck includes a plurality of rigid members. Such members are separately encased as a unit hingeable between the members. Several units may be securred together in a planar relationship to readily accomodate a particular size floatation sleep system bladder. The encasing is of a decorative nature to enhance the appearance of the deck.

The invention, and its objects and advantages, will become more apparent in the detailed description of the preferred embodiment presented below.

BRIEF DESCRIPTION OF THE DRAWINGS

In the detailed description of the preferred embodiment of the invention pressented below, reference is made to the accompanying drawings, in which.

DESCRIPTION OF THE PREFERRED EMBODIMENT

Figure 1:
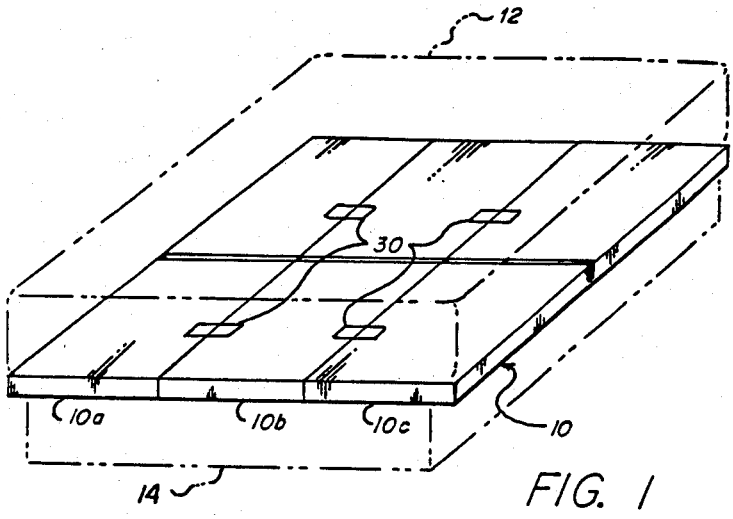
FIG. 1 is a view, in perspective of a floatation sleep system deck according to this invention, with the related pedestal and fluid-filled bladder being shown in phantom.

Referring now to the accompanying drawings, FIG. 1 shows a floatation sleep system deck according to this invention and generally designated by the numeral 10. The deck 10 lies in a plane and supports a fluid-filled bladder 12 (shown in phantom) of a floatation sleep system. In turn, the deck is supported by a pedestal 14 (shown in phantom) of such floatation sleep system.

Figure 2:
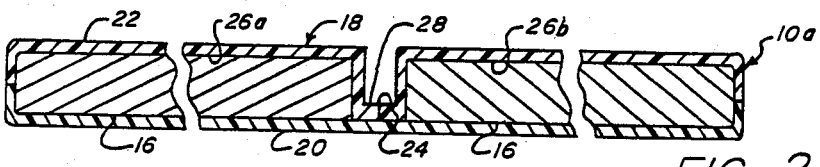
FIG. 2 is a side elevational view, in cross-section, of a deck of FIG. 1.
Figure 3:
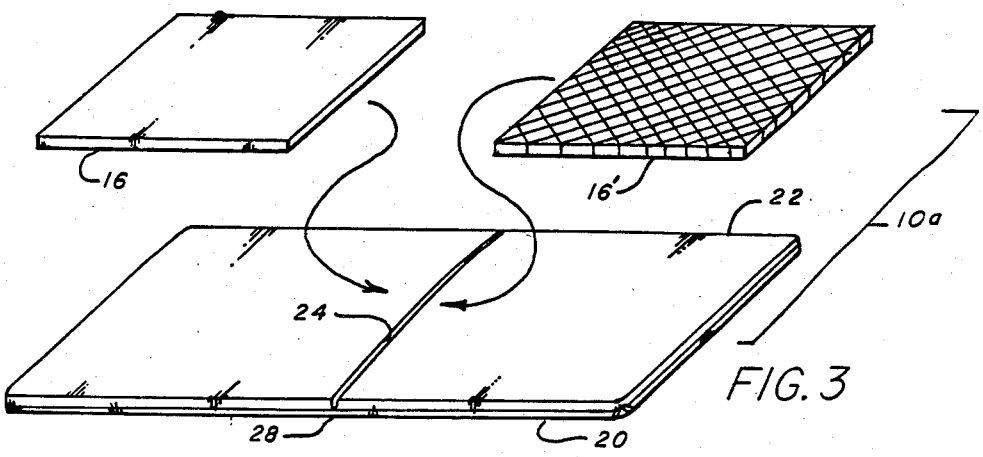
FIG. 3 is an exploded view, in perspective, showing the elements of the deck unit of FIG. 1 and how they are assembled.

The deck 10 is made up of a plurality of units (e.g., 10*a*, 10*b*, 10*c*) with an overal dimension so as to describe an area substantially equal to the surface area of the bladder 12. Each of the units of the deck 10 comprises a plurality of rigid members 16 encased in a jacket 18 (see FIG. 2). The rigid members 16 are formed of fiber board or flake board for example. Another material from which such rigid members may be formed is a honeycombed cardboard, the orientation of the corrugations forming the honeycombed structure lying in a direction to provide sufficient strength against compression when bearing the load of a fluid-filled bladder. Such last mentioned material is preferred for use with this invention because it offers a high strength to weight ratio. That is to say that the material made from the honeycombed cardboard will have the required strength to support a typical fluid-filled bladder, yet will be of light weight which makes it easier to transport and handle during set up. Additionally, a combination of honeycombed cardboard and hard board or a resin-coated honeycombed cardboard are suitable for use with this invention.

The jacket 18 for the deck unit is formed of a flexible, dimensionaly stable material such as polyethylene or polypropylene for example. The jacket includes a bottom sheet 20 and a top sheet 22 securred to the bottom sheet about the marginal perimeter thereof. The union of the top and bottom sheets may be effected by any suitable means such as heat sealing or gluing for example. Moreover, such union may be of a decorative configuration, such as a weld resembling a fabric weld utilized in conventional bedding construction, if so desired. The top sheet 22 is of a slightly longer dimension than the bottom sheet 20, in its longitudinal direction, and has a slit 24 extending in the transverse direction at approximately its mid-point to provide communication with the interior of the unit formed by the top and bottom sheets. The interior thus forms two cavities or pockets 26*a* and 26*b*. The pockets are adapted to respectively receive the rigid members 16 and 16' (of honeycomb cardboard) therein. Once the rigid members are inserted into the pockets, the slit 24 is sealed in any well known manner such as by heat sealing or gluing of the top sheet to the bottom sheet for example. Since the top sheet is slightly longer in its longitudinal dimension, there is sufficient material to accomplish the sealing action and form a hingeable connection 28 between the rigid member-containing pockets. The hingeable connection enables the deck unit to be folded into a compact configuration to facilitate transport and readily unfolded for set up on the pedestal to provide support for a fluid-filled bladder of a floatation sleep system.

Ideally, the units comprising the deck 10 of the floatation sleep system are dimensioned to be of a size wherein a particular number of units make up a deck to support a particular size fluid-filled bladder. As an illustrative example, for a common bladder size designated in the industry as a "single", the bladder has an approximate surface area of one meter by two meters; and for a common bladder size designated in the industry as a "queen", the bladder has an approximate surface area of one and one-half meters by two meters. Then by making each deck unit of a size to describe a surface area of one-half meter by two meters, two such units secured in side-by-side relationship will support the "single" bladder and three such units secured in side-by-side relationship will suport a "queen" bladder. The securing of the units in side-by-side relationship may be accomplished for example by providing connectable tabs or tape 30 on the jacket 18 of each unit, extending between adjacent units. The fact that the individual units are of the same overall surface area dimension facilitates manufacture of such units, as well as serving to reduce the complexity of set up of the units at the customer's site. Furthermore, with units of the above described dimensions, it is apparent that the units are each foldable into a compact configuration, measuring one-half meter by one meter, which is a convenient size for handling and transport. Of course, dimensioning the units to other sizes, and providing different arrangements of the units into decks to respectively support other particular size fluid-filled bladders, would depend only on the size of the fluid-filled bladder which it is desired to support by the deck of this invention.

The invention has been described in detail with a particular reference to a preferred embodiment thereof, but it will be understood that variations and modifications can be effected within the spirit and scope of the invention.

I claim:

1. A deck of a size and strength sufficient to support a fluid-filled bladder of a floatation sleep system, said deck adapted to be supported on a pedestal, said deck comprising:

a plurality of rigid members; and means for separately encasing said rigid members as a unit hingeable, between such members, said encasing means including a decorative, flexible material having a plurality of sealable pockets for receiving said plurality of rigid members respectively, whereby such unit is readily foldable to a compact configuration for handling and transport, and unfoldable to provide support for a fluid-filled bladder.

2. The invention of claim 1 wherein said rigid members are of substantially equal size.

3. The invention of claim 2 wherein a plurality of member-encased units are secured in a planar relationship and describe a surface area substantially equal to the surface area of a particular size fluid-filled bladder.

4. The invention of claim 1 wherein said rigid members are honeycombed material, the orientations of the corrugations forming the honeycombed structure lying in a direction to provide sufficient strength against compression when bearing the load of a fluid-filled bladder.

5. In a floatation sleep system including a fluid-filled bladder and a pedestal and deck for supporting said bladder, an improved deck construction comprising:

a plurality of rigid members which, when individually laid out in planar form on such pedestal, describe an overall dimensional area substantially equal to the planar surface area of such fluid-filled bladder;

a plurality of encasing means for respectively encasing at least two of said rigid members as a unit, hingeable between said members, said encasing means including a decorative, flexible material having a plurality of sealable pockets for receiving said at least two rigid members respectively; and means for securing adjacent encasing means in such planar relationship, thereby preventing relative movement therebetween.

6. The invention of claim 5 wherein said rigid members are honeycombed material, the orientation of the corrugations forming the honeycombed structure lying in a direction to provide sufficient strength against compression when bearing the load of a fluid-filled bladder.

* * * * *